US009308972B2

(12) United States Patent
Hallot et al.

(10) Patent No.: US 9,308,972 B2
(45) Date of Patent: Apr. 12, 2016

(54) MARINE MOUNTING PROVIDED WITH A DEVICE FOR STORING AND GUIDING HOSES

(75) Inventors: Raymond Hallot, Voisins-le-Bretonneux (FR); Cédric Bruguier, Paris (FR); Benjamin Mauries, Paris (FR)

(73) Assignee: Saipem S.A., Montigny le Bretonneux (FR)

( * ) Notice: Subject to any disclaimer, the term of this patent is extended or adjusted under 35 U.S.C. 154(b) by 367 days.

(21) Appl. No.: 13/885,088

(22) PCT Filed: Nov. 24, 2011

(86) PCT No.: PCT/EP2011/070967
§ 371 (c)(1),
(2), (4) Date: May 29, 2013

(87) PCT Pub. No.: WO2012/072497
PCT Pub. Date: Jun. 7, 2012

(65) Prior Publication Data

US 2014/0301807 A1 Oct. 9, 2014

(30) Foreign Application Priority Data

Nov. 30, 2010 (FR) ..... 10 59909

(51) Int. Cl.
*B63B 27/34* (2006.01)
*B65H 75/42* (2006.01)
(Continued)

(52) U.S. Cl.
CPC ..... *B63B 27/34* (2013.01); *B63B 35/00* (2013.01); *B65H 75/425* (2013.01); *B65H 75/4402* (2013.01); *B65H 75/4478* (2013.01); *B65H 2701/33* (2013.01)

(58) Field of Classification Search
CPC ..... B63B 35/00; B63B 27/34; B65H 75/425; B65H 75/4478; B65H 75/4402; B65H 2701/33
USPC ..... 414/137.9; 441/4, 5; 114/230.1, 232, 114/233; 141/59, 382, 387; 242/615, 615.2, 242/615.3; 137/355.16, 355.17
See application file for complete search history.

(56) References Cited

U.S. PATENT DOCUMENTS 3,742,536 A 7/1973 Sada et al.
3,912,225 A * 10/1975 Earnheart ..... 254/134.3 R
(Continued)

FOREIGN PATENT DOCUMENTS

WO WO 86/06339 11/1986
WO WO 01/04041 1/2001
WO WO 2006/070430 7/2006

OTHER PUBLICATIONS

International Search Report dated Dec. 15, 2011.

*Primary Examiner* — Saul Rodriguez
*Assistant Examiner* — Lynn Schwenning
(74) *Attorney, Agent, or Firm* — Cozen O'Connor

(57) ABSTRACT

A support installed at sea and fitted with a storage and guide device for storing and guiding flexible pipes, the support has a first carrier structure supporting a plurality of turntables arranged one above another, flexible pipes being wound in concentric juxtaposed spiral turns of increasing diameter resting on said turntables, a rotary joint enabling coupling to be established between (1) a first end closest to the center of the turntable of a flexible pipe on said turntable, and (2) an end of a transfer pipe that remains stationary while said turntable is being driven in rotation; a plurality of guides suitable for guiding portions of the flexible pipe outside the turntables.

20 Claims, 8 Drawing Sheets

(51) Int. Cl.
*B65H 75/44* (2006.01)
*B63B 35/00* (2006.01)

(56) References Cited

U.S. PATENT DOCUMENTS 3,982,402 A * 9/1976 Lang et al. ..... 405/168.3
4,393,906 A 7/1983 Gill
4,552,323 A * 11/1985 Otis ..... 242/594.3
5,205,768 A * 4/1993 Pollack ..... 441/5
5,797,413 A * 8/1998 Pollack ..... 137/1
6,193,574 B1 * 2/2001 Pollack ..... 441/4
7,438,617 B2 * 10/2008 Poldervaart et al. ..... 441/5
2007/0292243 A1 * 12/2007 De Baan ..... 414/141.3
2013/0216315 A1 * 8/2013 Pionetti et al. ..... 405/168.3

* cited by examiner

MARINE MOUNTING PROVIDED WITH A DEVICE FOR STORING AND GUIDING HOSES

RELATED APPLICATION

This is a U.S. national stage of application No. PCT/EP2011/070967, filed on Nov. 24, 2011. Priority is claimed on the following application: French Application No. 1059909 filed on Nov. 30, 2010, the content of which is incorporated here by reference.

FIELD OF THE INVENTION

The present invention relates to a support installed in open sea in grounded or floating manner, i.e. respectively resting on or anchored to the bottom of the sea, said support being fitted on its surface with a device for storing and guiding flexible pipes, which device is suitable for storing and guiding a plurality, preferably at least three, of said flexible pipes usable for transferring petroleum fluids at sea.

The storage and guide device for flexible pipes arranged on board a support of the invention serves to handle said flexible pipes in order to store them in the wound state between two transfers of fluid within said flexible pipes between the floating support and an offloading ship, and for unwinding said pipes in order to perform a said fluid transfer between a said floating support and a said ship, preferably of the methane tanker type.

A more particular technical field of use of a support of the invention is the field of offloading petroleum fluids at sea, including equally well liquid crude oil or gasoil or liquefied gas, in particular liquefied natural gas (LNG), or indeed gas in the gaseous state, from a said support, e.g. at an oil field, to an offloading ship that may be arranged alongside or in tandem, as explained below.

The technical sector of the invention is still more particularly the field of transferring liquefied natural gas (LNG) at −165° C. while at sea, between a floating support having at least one LNG storage tank and a ship, preferably of the methane tanker type, arranged in tandem or alongside, i.e. at a certain distance from the floating support in the same longitudinal direction as said floating support, or parallel thereto.

BACKGROUND OF THE INVENTION

On oil fields in open sea, situated a long way off-shore, petroleum fluids such as crude oil or gas are generally recovered, processed, and stored on board a said floating support often referred to as an FPSO (floating-production-storage-offloading). Petroleum fluids such as crude oil and/or gas are then exported by offloading ships that call regularly, e.g. every week, to recover the production from the oil fields. Three techniques are commonly used for this purpose.

A first technique consists in installing a buoy a long way from the FPSO, i.e. at about 1000 meters (m) to 1500 m, which buoy is referred to as a loading buoy and is connected to the FPSO by an undersea pipe, with oil or gas being transferred to said loading buoy via said undersea pipe. An offloading tanker then moors on said loading buoy and the load is recovered via flexible connection pipes connected to said buoy floating on the surface of the sea, the oil or gas then being driven by a pump on board the FPSO in order to load the offloading tanker.

A second technique consists in causing the offloading tanker to draw up alongside the FPSO, i.e. side against side. Under such circumstances, transfer is performed either by hinge-type loading arms, as is common practice for transfers in port, or else by flexible pipes of short length.

A third technique consists in placing the offloading ship in tandem with the FPSO, i.e. the offloading ship takes up a position on the axis of the FPSO at a safe distance of at least 50 m to 150 m, and then moors thereto, after which it recovers the ends of floating pipes that extend from the floating support where they are connected to a tank at their ends opposite from their ends floating on the sea, the recovered ends being connected on board said offloading ship, and oil or gas then being driven by a pump from the FPSO in order to load the offloading tanker.

On oil fields, it is generally preferred to use a loading buoy, while nevertheless associating it in general with a redundancy device that may be either an alongside device, i.e. a device in which the offloading ship is arranged alongside the FPSO, or else a tandem device, i.e. a device in which an offloading ship is arranged in tandem with the FPSO, and sometimes even both such devices.

In all configurations, with crude oil, the connection pipes connected either to a loading buoy or to an offloading ship are kept full, either with crude oil or else with an oil product, generally gasoil, that takes the place of crude oil when there is a risk of the crude oil solidifying (paraffinic crudes).

In contrast, when transferring liquefied gas of the LNG type at −165° C., transfer devices include at least one go connection pipe for the liquefied gas and a return connection pipe, in general of smaller diameter, for removing gas from the tanks of the offloading ship progressively as they are filled with LNG, and in particular for removing methane gas so that it can be reliquefied on board the FPSO. Furthermore, the connecting flexible pipes need to be emptied practically completely after offloading so as to avoid ice forming and accumulating on said pipes and more particularly on the mechanical connections of said pipes. Furthermore, the pipes need to include extremely good insulation so as to limit the amount of liquid methane (LNG) that is regassified during transfer. That is why, for this purpose, it is preferred to use offloading techniques with alongside and tandem devices in which firstly the connecting pipes are not undersea pipes but rather pipes that float on the surface, and secondly said pipes are of relatively short length.

Nevertheless, offloading alongside is very difficult since it is possible to envisage bringing an offloading ship into a position parallel with the FPSO and at a distance of less than 5 m therefrom only under sea conditions that are very clement. With rough sea, transfer becomes impossible, and if the FPSO is full that can make it necessary to stop production, which constitutes a serious handicap for the profitability of installations exploiting the oil fields in question. The transfer means are then constituted either by conventional loading arms, or by devices having flexible pipes installed on board said FPSO. Patent EP-2 239 190 describes such an alongside offloading device.

Tandem offloading presents much greater safety, but offloading pipes are longer and therefore more complicated to handle and store on board the FPSO. For this purpose, numerous devices have been developed for storing and guiding flexible pipes on board an FPSO. Some of them use of a considerable carrier structure of the hinge type supporting a plurality of rigid pipes including rotary joints as hinges, as described in detail in U.S. Pat. No. 4,393,906.

Other solutions include using rigid pipes hinged with rotary joints, or flexible pipes arranged in festoons between the FPSO and the offloading ship, as explained in patent WO 01/04041.

Another technical field is one in which LNG is stored at sea close to a utilization site, e.g. in order to deliver gas to land after it has been regassified, or indeed to transform it on site into electricity for delivering said electricity to the local network. Under such circumstances, the ship comes to unload its cargo of LNG and the floating support is referred to as an FSRU (floating storage regasification unit).

SUMMARY OF THE INVENTION

The object of the present invention is to provide an improved alongside or tandem offloading device between a support and an offloading ship.

More particularly, the object of the present invention is to provide a support at sea fitted with a device for supporting and guiding flexible pipes that makes it easier for said pipes to be handled in order to transfer fluid between the floating support and an offloading ship and also in order to store said flexible pipes on board the floating support between two transfers.

A problem to be solved by the present invention is providing a device for storing and guiding said flexible pipes that makes it possible in controlled manner to adjust the tension and the length between said floating support and said offloading ship, in particular so as to avoid interference between a plurality of connection pipes extending between said floating support and said offloading ship from the storage and guide device.

To do this, the present invention consists essentially in a support installed at sea and fitted with a device for storing and guiding flexible pipes, the device comprising:

- a first carrier structure supporting a plurality of turntables arranged one above another;
- flexible pipes wound or suitable for being wound in concentric juxtaposed spiral turns of increasing diameters resting on the top faces of said turntables;
- a rotary joint coupling enabling a coupling to be made between firstly a first end closest to the center of the turntable of a flexible pipe wound on said turntable and suitable for being driven in rotation together with said storing and guiding, and secondly an end of a transfer pipe that remains stationary when said turntable is driven in rotation, and that is preferably in communication with at least one first tank within said support; and
- a plurality of guide means suitable for guiding the portions of said flexible pipes outside said turntables in continuity with the remaining pipe portions resting on said turntables, in such a manner that said pipe portions leaving said turntables are arranged in straight lines at different positions in a horizontal direction $Y_1Y'_1$ parallel to said side, at heights that are different and that are capable of adopting different orientations $\alpha 1$, $\alpha 2$, $\alpha 3$ for their vertical axial planes P1, P2, P3 relative to said horizontal direction $Y_1Y_1'$ parallel to said side.

More precisely, the present invention provides a support installed at sea, in grounded or floating manner, said support being fitted on its surface with a storage and guide device for storing and guiding flexible pipes and suitable for storing and guiding a plurality of said flexible pipes, and preferably at least three of them, the support being characterized in that the storage and guide device comprises:

- a first carrier structure resting on or secured to the deck of said support close to a side of said support, preferably a longitudinal end wall of said support, said first carrier structure supporting a plurality of circular turntables arranged one above another;
- each of said turntables being suitable for being driven in rotation in powered manner by a first motor about a vertical central axis ZZ' independently of one another, preferably about the same vertical central axis ZZ', each turntable having a central orifice surmounted by a central cylinder against and around which a said flexible pipe can be wound in concentric juxtaposed spiral turns of increasing diameter resting on the top face of said turntable, said central orifice of said turntable being fitted with a rotary joint coupling suitable for providing coupling between firstly a first end that is closest to said central cylinder of a flexible pipe wound around said flexible cylinder, said first pipe end being suitable for being driven in rotation together with said turntable, and secondly an end of a stationary transfer pipe having its other end in communication with at least one first tank within said support; and
- a plurality of guide means, each said guide means being suitable for guiding the portion of said pipe leaving a respective one of each of said turntables in continuity with the portion of pipe wound on said turntable, in such a manner that the various said pipe portions leaving the various turntables are arranged in straight lines, being offset in different positions along a horizontal direction $Y_1Y'_1$ parallel to said side, at different heights, and capable of adopting different orientations for their vertical axial planes relative to said horizontal direction $Y_1Y_1'$ parallel to said side.

It can be understood that the pipe portion leaving the turntable corresponds to the unwound pipe portion in continuity with the last turn of the wound pipe, in particular during winding or unwinding.

The device of the invention is particularly advantageous for positioning the various pipes leaving the turntables relative to one another and for independently adjusting their lengths and/or tensions between said turntables and the second ends of the flexible pipes leading in particular to a second ship, in particular an offloading ship, in such a manner as to avoid the pipes from interfering with one another or indeed striking one another, in particular while unwinding or winding a pipe respectively before or after deployment of said pipe between said floating support and said offloading ship.

This independent adjustment of the rotation of the various turntables is particularly useful and advantageous when the various flexible pipes wound on the various turntables are of different diameters and therefore require different winding or unwinding speeds in order to maintain substantially constant length or tension on leaving said turntables while the pipes are being wound and unwound.

This applies in particular when transferring liquefied gas of the LNG type from a floating support of the invention to an offloading ship while another flexible pipe, generally of smaller diameter, is being used to transfer gas in the gaseous state corresponding to the gas ceilings in the tanks, from said offloading ship back to said floating ship, as explained below.

Of a vessel (ship or floating support), the term "side" is used herein to mean any external wall of the hull of the vessel, i.e. not only the longitudinally extending lateral walls of the hull but also transverse walls at the longitudinal ends thereof, i.e. the bow and stern walls of said vessel.

The term "flexible pipe" is used herein for pipes also known as "hoses" that are well known to the person skilled in the art and that are described in standards documents published by the American Petroleum Institute (API), more particularly under the references API 17J and API RP 17 B. Such hoses are manufactured and sold in particular by the supplier Coflexip in France. Such flexible pipes generally comprise inner sealing layers of thermoplastic materials associated with layers that withstand pressure inside the pipe, generally made of steel or of composite materials and in the form of strips wound in touching spiral turns inside the thermoplastic pipe in order to withstand the internal bursting pressure, and associated with external reinforcement over the tubular thermoplastic layer and likewise in the form of strips that are spiral-wound with touching turns, but at a longer pitch, i.e. with a smaller angle of inclination for the helix, in particular lying in the range 15° to 55°.

More particularly, at least one said flexible pipe is wound against and around a said central cylinder in concentric juxtaposed spiral turns of increasing diameters resting on said turntable, said central cylinder presenting a radius greater than the minimum radius of curvature of said flexible pipe, there being preferably at least three flexible pipes wound respectively on at least three said turntables, including at least one flexible pipe of diameter smaller than the others.

The assembly comprising said storage and guide device, said flexible pipes that are guided with the help of a said storage and guide device, and where appropriate and first and second connection and valve devices constitutes a device for transferring fluid from a said support installed at sea, and preferably to a said ship.

The present invention also provides a method of transferring a liquid or gaseous petroleum fluid, wherein a said petroleum fluid is transferred via at least two flexible pipes, preferably via at least three flexible pipes, extending between a said support of the invention and a ship, preferably of the methane tanker type, arranged alongside or in tandem adjacent to said floating support and facing said side, said flexible pipes being guided with the help of a said storage and guide device.

In a first implementation, said transfer consists in offloading liquefied gas from said support to a said ship referred to as an offloading ship.

In a second implementation, said transfer consists in loading liquefied gas onto said support from a said ship, referred to as a supply ship. In general this involves loading liquefied gas that is regassified within said support in order to be transferred to land in gaseous form or in order to be used to produce electricity. Under such circumstances, said floating support may also contain a unit for producing electricity from said gas and a transformer station for delivering electricity to land. Under such circumstances, said support is advantageously a support grounded on the sea bottom.

Advantageously, in a transfer method of the invention, said flexible pipes are floating pipes, floating on the surface over a fraction of the distance between said support and said ship, preferably of the methane tanker type.

Still more particularly, in a transfer method of the invention, use is made of at least one flexible pipe, a "first" flexible pipe, and preferably of at least two flexible pipes, "first" and "second" flexible pipes, within which liquefied gas is transferred between said floating support and at least one second tank of said ship, preferably of the methane tanker tank, and of a third flexible pipe, preferably of diameter smaller than the diameter of said first and second flexible pipes, within which gas corresponding to the gas ceiling of the second tank is transferred between a said second tank to a first tank within said floating support or to a liquefaction unit on a said support prior to being transferred to a said first tank.

In particular, when said methane tanker is an offloading ship and said liquefied gas is being offloaded from said floating support to said offloading ship, gas return from said offloading ship to said floating support takes place progressively as said second tank within said offloading ship is filled.

More particularly, in a floating support of the invention, each guide means is arranged at a different height facing a respective one of each of said turntables so as to be suitable for supporting an intermediate curved pipe portion between a downstream portion of said pipe in a substantially vertical position beside said side and a said upstream pipe portion leaving the turntable in continuity with the wound pipe portion resting on a said turntable, said upstream pipe portion leaving the turntable extending on a virtual plane P that is substantially tangential to the surface of the top face of said turntable on which said wound pipe portion is wound, the various downstream pipe portions in substantially vertical positions beside said side being arranged in positions that are offset relative to one another in a said direction $Y_2Y_2'$ parallel to said side on leaving said sheaves.

Still more particularly, each said guide means comprises a sheave mounted to revolve about a horizontal first axis of rotation $Y_1Y_1'$, said sheave also being suitable for swiveling, preferably freely, about a vertical second axis of rotation $Z_1Z_1'$ extending along a diameter of the sheave, said first axis of rotation about which each said sheave revolves preferably being controlled by a second motor, preferably synchronously with said first motor of each said turntable.

Thus, because said sheave is free to swivel about its vertical second axis of rotation $Z_1Z_1'$ and because said synchronous motor-driven rotation of said sheave about its horizontal first axis of rotation $Y_1Y_1'$, a said curved intermediate pipe portion supported by said sheave can remain permanently in the same substantially vertical plane P1, P2, P3 as a said upstream pipe portion leaving the turntable, with the various planes P1, P2, P3 being oriented at different angles $\alpha$1, $\alpha$2, 3 relative to said direction $Y_1Y'_1$ in order to reach said turntables in continuity and in tangential alignment with the ends of the last turns of the pipes wound thereon, thus enabling the pipes to be properly spooled progressively as they are wound or unwound about said central cylinders.

It can be understood that such a vertical axial plane P1, P2, P3 is the common substantially vertical plane in which the upstream and intermediate portions of a pipe are situated, whereas in contrast the axial plane of the downstream pipe portion in a substantially vertical position is not necessarily situated in the same vertical plane.

In a variant embodiment of a floating support of the invention, said guide means are constituted merely by chutes.

Still more particularly, the various sheaves are arranged offset side by side relative to one another in said horizontal direction $Y_1Y'_1$ parallel to said side at different heights, the top of each sheave preferably being positioned substantially level with a plane P tangential to the top face of a said turntable.

It can be understood that the various downstream pipe portions in substantially vertical positions beside said side are thus arranged side by side in a said direction $Y_1Y_1'$ that is preferably parallel to said side at the outlet from said sheaves, with each sheave preferably being adjustable in height relative to said portion of its said second carrier structure fastened to said side.

Still more particularly, each sheave is supported by a second carrier structure arranged outside said floating support and fastened to a common side at a different position in a said horizontal direction $Y_1Y_1'$ parallel to said side, each sheave being mounted to swivel about said vertical second axis of rotation $Z_1Z_1'$relative to a portion of its said second carrier structure fastened to said side.

Still more particularly, each said turntable includes or co-operates on its under face with wheels suitable for co-operating with or respectively supported by elements of said carrier structure, and each said turntable including a bearing at said central orifice, the bearing being secured to said carrier structure and being suitable for enabling said turntable to rotate relative to said first carrier structure.

In variant embodiments, said turntables may be such that:

at least one said turntable presents a top face that is plane and horizontal;

at least one said turntable presents a top face of concave frustoconical shape, with an angle $\gamma$ at the apex preferably lying in the range 160° to 178°; and at least one said turntable presents a top face of convex frustoconical shape, with an angle $\gamma$ at the apex preferably lying in the range 160° to 178°.

The term "concave" or "convex" is used herein of a frustoconical shape to indicate that the virtual apex of said cone lies below or respectively above said surface of frustoconical shape. It can be understood that the cone angle $\alpha$ relative to the horizontal lies in the range 10 to 100.

A turntable of convex or concave frustoconical shape is particularly useful for purging the residual load from a flexible pipe filled with liquid, and in particular liquefied gas, when the pipe is stored and wound on its said turntable, as explained below.

According to another advantageous characteristic of the support of the invention, it is fitted with a plurality, n, of flexible pipes each co-operating at its said first end with a respective said turntable, said flexible pipes being connected together at their second ends by a first connection and valve device having n preferably rigid first pipe portions held in preferably parallel fixed positions relative to one another, n being an integer not less than 3, each said first pipe portion comprising:

at a first end, a first pipe coupling element, preferably a male or female portion of an automatic connector;

at its second end, a second coupling element, preferably a flange, assembled to the second end of a said flexible pipe;

each said first pipe portion including, between its two ends n−1 branch connections enabling it to communicate with respective ones of the n−1 other said first rigid pipe portions, each said branch connection including a first communication valve;

a first connection valve situated between said first coupling element and said branch connection;

said first pipe portions preferably being held parallel by a first rigid support to which they are secured; and said first communication valves preferably being butterfly valves and said first connection valves preferably being ball valves.

It can be understood that each first connection valve situated between said first coupling element and said branch connection is suitable for allowing or preventing fluid from flowing in said first pipe portion towards or from said first coupling element when the valve is respectively open or closed.

According to another preferred characteristic of the support of the invention, said flexible pipes extend or are suitable for extending between said support and a ship, preferably of the methane tanker type, arranged alongside said support or in tandem facing said side, and said first connection and valve device is connected to a second connection and valve device arranged or suitable for being arranged on board said preferably methane tanker type ship, said second connection and valve device comprising:

n preferably rigid second pipe portions;

each said second pipe portion communicating at one of its ends with a said second tank and including at its other end a first complementary pipe coupling element, said first complementary coupling element being suitable for co-operating in reversible coupling with a said first coupling element, said first complementary coupling element preferably being a female or male automatic connector portion, respectively;

said second pipe portions being held in preferably parallel fixed positions relative to one another so as to enable said first complementary coupling element to be coupled with said first coupling element;

each said second pipe portion having a second connection valve suitable for allowing or preventing fluid from flowing in said second pipe portion towards or from said first complementary coupling element when open or closed, respectively;

said second pipe portions preferably being held parallel to one another by a second rigid support to which they are secured; and said second connection valves preferably being ball valves.

A support as defined above is particularly useful and advantageous for achieving almost complete purging of flexible pipes before they are unwound onto their turntables, thereby avoiding any damage to said flexible pipes and also making them easier to rewind onto their said turntables.

The present invention thus also provides a method of the invention in which said flexible pipes are fitted with a said first connection and valve device as defined above that is connected to a said second connection and valve device as defined above, said flexible pipes preferably being floating flexible pipes, and after said liquid petroleum fluid has been transferred between said support and said ship, preferably a methane tanker, said flexible pipes that have been used for transferring the liquid fluid, preferably LNG liquefied natural gas from said support to said offloading ship, are purged by performing the following successive steps:

a. closing said first and second connection valves, and disconnecting said first and second connection and valve devices from each other;

b. injecting gas into the first end of a first flexible pipe from said support and opening at least one said first communication valve between said first flexible pipe and a second flexible pipe assembled to the same said first connection and valve device, the other said first communication valves being closed; and then c. closing said first communication valve between said first and second flexible pipes when said first pipe has been emptied sufficiently, and preferably substantially completely emptied.

Emptying is said to be "sufficient" when the inside volume of said pipe filled with residual fluid represents no more than 10% of the total inside volume of said pipe, preferably no more than 5%, i.e. an inside volume that is at least 90% empty, preferably at least 95% empty, and more preferably at least 98% of its total internal volume is empty.

The method thus makes it possible to empty the content of said first flexible pipe via said second flexible pipe, thereby making it possible after step c) to empty said first flexible pipe substantially or indeed completely. In contrast, there may still remain in general at least 10% and possibly up to 15% of the inside volume of said second pipe that has not been emptied, even when the inside volume of said first pipe has been emptied completely.

It is particularly difficult to empty the second flexible pipe completely after step c), since the end portion of the second flexible pipe corresponding to the substantially vertical portion between sea level and the level of its access to the turntable with which it co-operates generally remains at least partially filled with fluid after step c) because the two-phase fluid is moving upwards while gravity naturally tends to bring it back down to sea level.

Preferably, in the transfer method of the invention, after step c), said second pipe is purged completely by performing the following successive steps:

d. injecting gas from the support into said first end of said second pipe and opening said first communication valve between said second pipe and a third flexible pipe of smaller diameter than said second pipe so that the flow rate of purge gas is such that the speed of said gas is greater than 1.5 meters per second (m/s), preferably greater than 3 m/s, more preferably greater than 5 m/s, said other first communication valves being closed; and e. closing said first communication valve between said second and third pipes when said second pipe has been emptied sufficiently, and preferably emptied substantially completely.

It can be understood that in this implementation, the inside volume of the liquid fluid contained in the second pipe is removed completely via said third pipe.

The fact that said third pipe is of smaller diameter facilitates complete emptying of said third pipe, in particular in its substantially vertical portion between sea level and its entry onto the corresponding turntable after step e), once said second pipe has been substantially completely emptied. It is particularly advantageous to perform the combination of steps a) to e) in order to empty all three of said first, second, and third pipes.

Still more particularly, when all of said flexible pipes have been purged sufficiently, said flexible pipes are rewound onto their said turntables until the second ends of all of said flexible pipes are above water, preferably with said first connection and valve device coming just under the lowest of the turntables co-operating with one of said flexible pipes.

It can be understood that said first valve and connection device remains permanently fastened to said second ends of all of said first flexible pipes with which it co-operates when it is desired to rewind said flexible pipes, and that said first connection and valve device remains above water, preferably close to the level of the lowest turntable.

Also advantageously, said first pipe is wound on a said turntable that is convex as defined above.

Still more particularly, at least one of said second and third pipes used for transporting liquid, and preferably both of said second and third pipes used for transporting liquid, is (or are) wound on a said frustoconical turntable of concave shape as defined above.

It can be understood that any residual liquid in said second and third pipes can thus flow towards the tank via said lower first ends of said pipes under residual natural gravity while the pipe is being wound.

BRIEF DESCRIPTION OF THE DRAWINGS

Other characteristics and advantages of the present invention appear better in the light of the following detailed description made by way of non-limiting illustration and with reference to the drawings, in which.

DETAILED DESCRIPTION OF THE PRESENTLY PREFERRED EMBODIMENTS

Figure 1A:
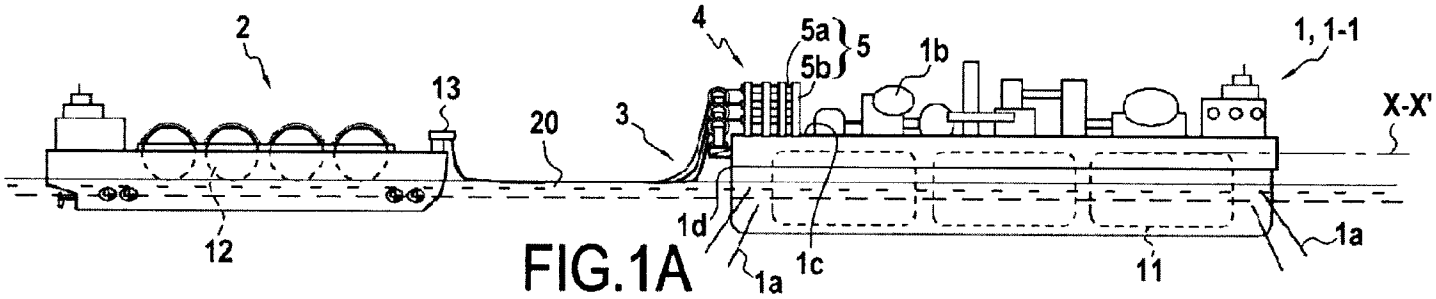
FIG. 1A is a side view of a floating support 1, 1-1 of the FPSO type for producing and storing LNG shown while offloading to a ship, referred to herein as an offloading ship 2 of the methane tanker type, in a so-called "tandem" configuration, the FPSO being fitted with a flexible pipe storage and guide device 4 of the invention.

FIG. 1A is a side view of a floating support 1 of the invention of FPSO type 1-1 anchored 1*a* on a gas production field in open sea.

Said FPSO possesses equipment 1*b* for processing and liquefying gas together with first tanks 11 for storing LNG incorporated within its hull.

A methane tanker type offloading ship 2 is positioned in tandem substantially on the axis of said FPSO and is connected thereto by a set of three flexible pipes 3A, 3B, and 3C that are handled by means of a storage and guide device 4 of the invention for storing and guiding flexible pipes 3, which device is described in greater detail below.

Said flexible pipes 3 are floating flexible pipes of the type manufactured and sold by the supplier Trelleborg (France), being constituted essentially by metal or composite reinforcement together with thermoplastics or vulcanized elastomers.

Such pipes for offload transfer of liquefied gas conventionally presents inside diameters lying in the range 250 millimeters (mm) to 600 mm, and outside diameters in the range 400 mm to 1000 mm. They are generally manufactured in lengths of 12 m and they are assembled together via their ends that are fitted with flanges so as to obtain lengths lying in the range 120 m to 250 m. In the same manner, the pipes for return transfer of gas in the gaseous state between the offloading ship 2 and the floating support 1 in a manner that is explained below, present the same total lengths but are advantageously of smaller diameter, having an inside diameter lying in the range 150 mm to 400 mm.

Under certain circumstances, it is preferable for gas return to have pipes that areentical to the LNG transfer pipes, thereby presenting an advantage in terms of storing spare parts, since all of the elements are thenentical.

Figure 2:
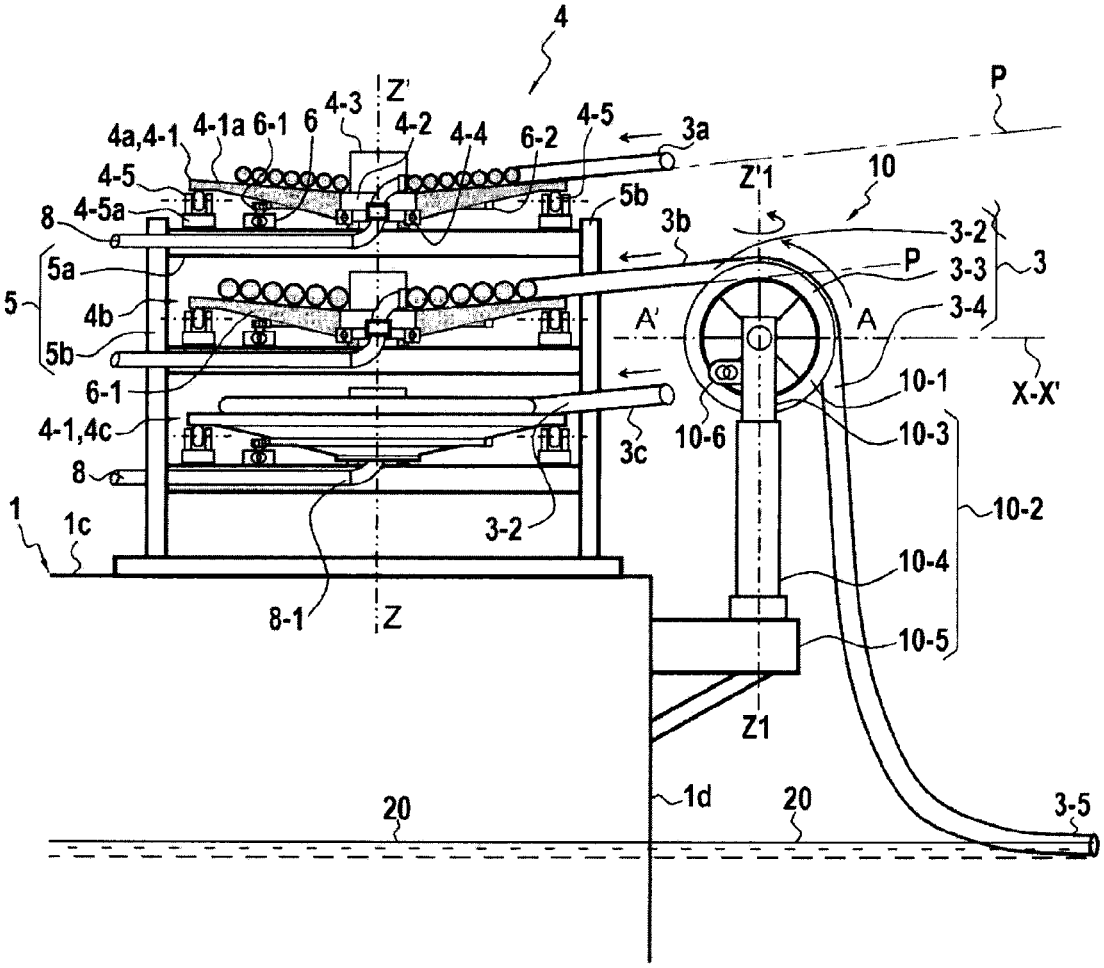
FIG. 2 is a side view, partially in section, showing the storage and guide device 4 of the invention having three superposed turntables 4-1, with FIG. 2 showing only one single flexible pipe guide means 10 with a sheave facing the central turntable so that the various elements making up said guide means can be seen more clearly.

FIG. 2 is a side view partially in section of the device 4 for storing and guiding flexible pipes 3. The storage device is constituted by a plurality, three in this example, of turntables 4-1, 4*a*, 4*b*, 4*c* arranged one above another, preferably on a common vertical axis of rotation ZZ'.

The three turntables 4-1 are supported by a first carrier structure 5 resting on the deck 1*c* of the floating support 1 close to a side and at one of its longitudinal ends.

Figure 3:
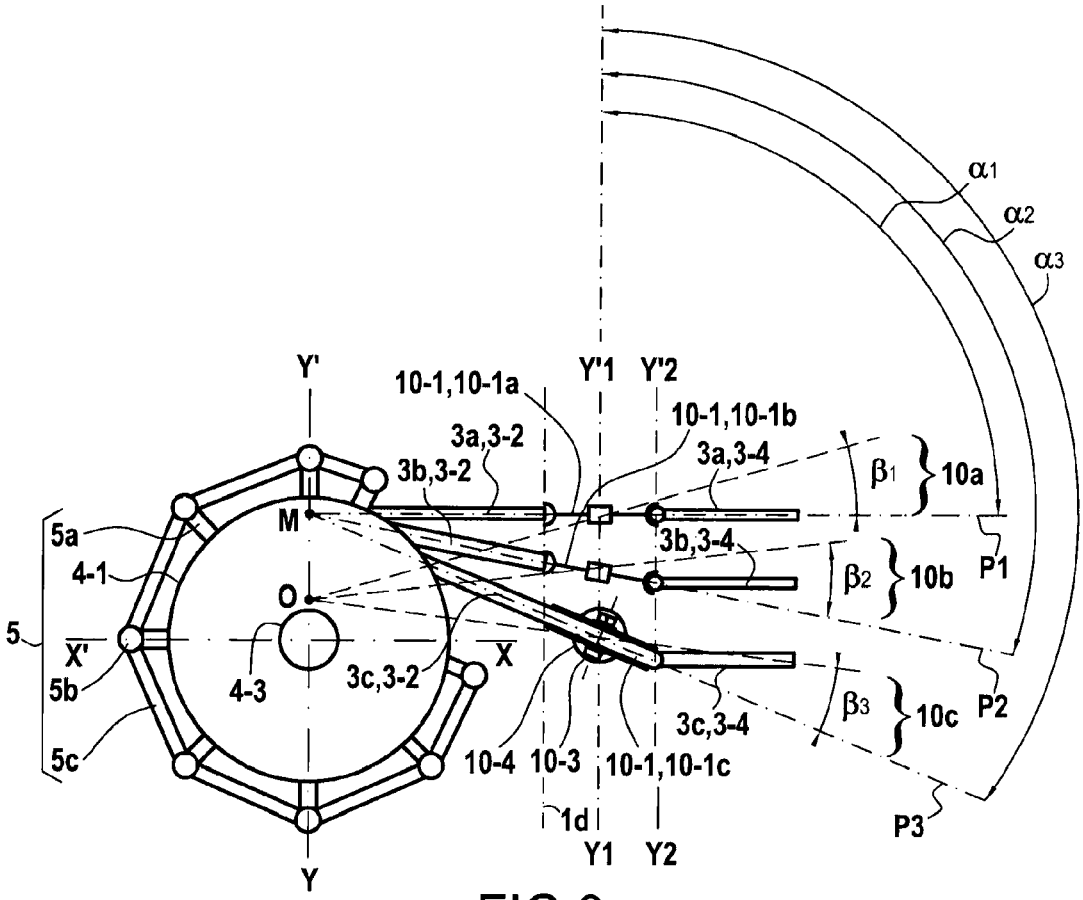
FIG. 3 is a plan view of the FIG. 2 storage and guide device fitted with three guide means 10-1*a*, 10-1*b*, and 10-1*c* that are offset from one another in the horizontal direction $Y_1Y'_1$ parallel to the side on which they are fastened; said top turntable 4-1*a* being shown without the pipe portion that is normally spiral-wound thereon in continuity with the pipe portion 3-2 leaving the turntable, in order to show the various possible angles of orientation of the pipe portions 3-2 leaving the turntables.
Figure 3A:
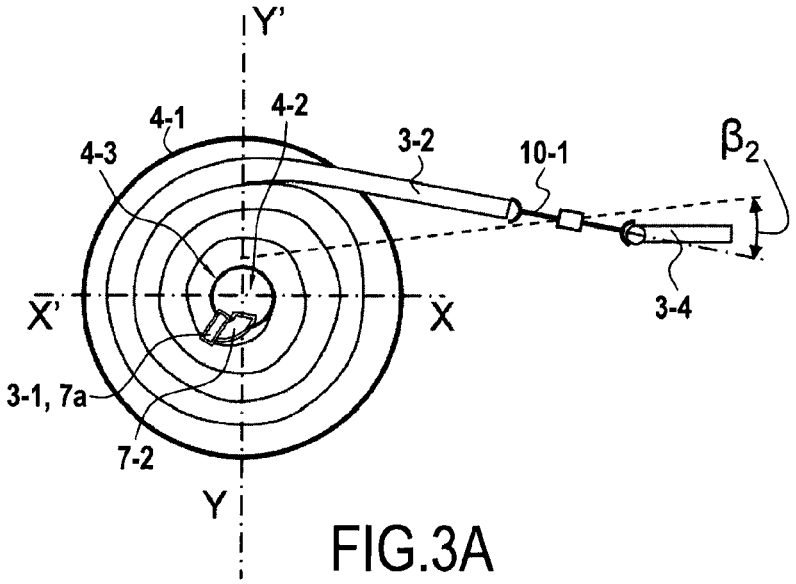
FIG. 3A is a plan view of a turntable of the FIG. 3 device having a spiral-wound flexible pipe portion 3 shown thereon, the sheave 10-1 being shown in section on AA' of FIG. 2.

As shown in FIG. 3, the first carrier structure 5 in this example has eight vertical posts 5*b* that are connected together by first horizontal beams 5*c* at different heights, and by second horizontal beams 5*a* arranged radially and diametrically between the diametrically opposite vertical posts 5*b*. Said horizontal beams 5*a* constitute horizontal carrier structures at three different heights, each suitable for supporting one of the three turntables 4-1.

At its center, each of said turntables presents an orifice 4-2 together with a bearing 4-4, e.g. a roller bearing, said bearing being secured in part to a said horizontal carrier structure 5*a* and enabling said rotation of the turntable about its central axis of rotation ZZ' with the help of a first motor 6 and of wheels 4-5 that are described below.

Each turntable 4-1 is supported at its periphery and via its bottom face by a series of wheels 4-5, that are preferably uniformly distributed around its periphery, the supports 4-5*a* of said wheels 4-5 being secured to a said horizontal carrier structure 5*a*.

Each turntable 4-1 is set into rotation about its vertical axis ZZ' by means of a first motor 6, preferably a hydraulic motor, that imparts rotary drive to an outlet shaft carrying a gear that co-operates with a toothed wheel 6-1 secured to said turntable 4-1, thereby driving said turntable in rotation when said outlet shaft is itself driven in rotation.

A central cylinder 4-3 is arranged on top of said orifice 4-2 in each of said turntables. The outside radius of said central cylinder 4-3 is greater than the minimum radius of curvature of said flexible pipe that is to be wound with concentric touching spiral turns resting side by side on said turntable. Said central cylinder 4-3 is secured to said turntable 4-1.

Figure 4A:
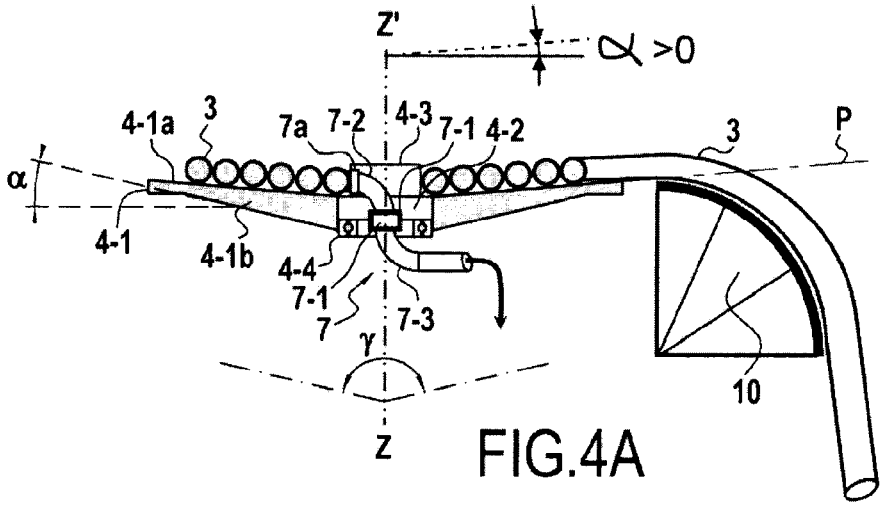
FIGS. 4A, 4B, and 4C are side views of a turntable having a top face of frustoconical shape that is concave (FIG. 4A), of frustoconical shape that is convex (FIG. 4B), or of plane shape (FIG. 4C), with a flexible pipe spiral-wound thereon and bent around guide means 10 at the outlet from said storage turntable.
Figure 4B:
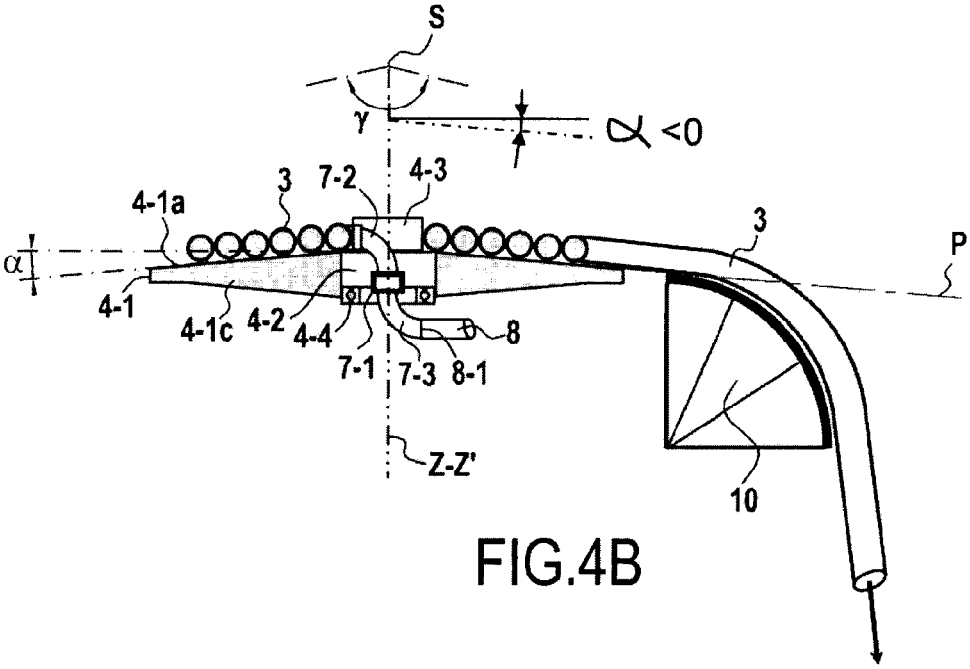
Figure 4C:
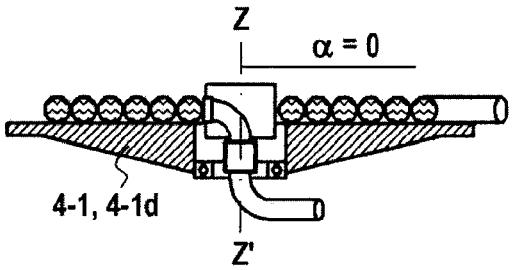

As shown in FIG. 4, a rotary joint coupling 7 of type known to the person skilled in the art is installed on the axis ZZ' of each said turntable 4-1.

It is constituted by a rotary joint proper 7-1 having a top portion fitted with a top bend 7-2 with its end coming against the wall of said central cylinder 4-3.

The end of the top bend 7-2 is connected in leaktight manner at 7*a* to a first end 3-1 of a flexible pipe 3 that is to be spiral-wound against and around said central cylinder 4-3 when said turntable 4-1 is driven in rotation. The bottom portion of the rotary joint 7-1 comprises a bottom 7-3 that remains stationary while said top bend 7-2 is driven in rotating by rotation of said turntable 4-1. The bottom bend 7-3 is itself connected in leaktight manner to an end 8-1 of a transfer pipe 8 having its other end connected either to a first tank 11 of the FPSO 1, thereby enabling LNG coming from said first tank 11 to be taken to the FPSO 1, or else to a reliquefaction unit on board the FPSO, thereby enabling gas coming from said offloading ship 2 to be returned to said reliquefaction unit.

All of the various transfer pipes 8 pass through respective central orifices 4-2 of the various turntables 4-1.

Each flexible pipe 3, 3*a*-3*b*-3*c* is guided by guide means 10, only one of which is shown in FIG. 2, each guide means 10 comprising a sheave 10-1 arranged in a substantially vertical axial plane and suitable for revolving fast about a horizontal first axis of rotation $Y_1Y_1'$.

The sheave 10-1 presents a radius that is greater than the minimum radius of curvature of said flexible pipe 3 that is to be wound around said sheave.

Said sheaves 10-1, 10-1*a*, 10-1*b*, 10-1*c* are arranged close to and facing respective ones of said turntables 4-1 in such a manner that the groove in each of said sheaves has its highest point substantially level with a virtual plane P that is tangential to the top face 4-1*a*, which virtual plane P has resting thereon the pipe portion 3-2 that leaves said turntable.

In other words, the generator line for the surface of revolution constituting the top face 4-1*a* of said circular turntable 4-1 is tangential to the groove of said sheave at its highest point.

In this way, the flexible pipe portion 3-2 leaving said turntable 4-1, i.e. that is in continuity with the last turn wound on said turntable 4-1, is guided more accurately during operations of winding and unwinding said pipe during rotation of said turntable 4-1 and during rotation of said sheave 10-1 about its horizontal axis $X_1X'_1$.

Each sheave 10-1 is secured to a second carrier structure 10-1 comprising a vertical support 10-3 terminated at its top end by a fork supporting the horizontal hub arranged on the first axis of rotation $Y_1Y'_1$ about which the sheave 10-1*a* of FIG. 3 revolves, said vertical support 10-3 being hinged to swivel about a vertical second axis of rotation $Z_1Z'_1$ at the top of a stationary pylon 10-4 resting on a structure 10-5 that is itself secured to the hull of the FPSO 1 on said side 1*d*. Because said vertical support 10-3 can be hinged to swivel freely about its vertical axis $Z_1Z'_1$, said sheave 10-1 is suitable for swiveling about said vertical second axis of rotation $Z_1Z'_1$.

Furthermore, the vertical support 10-3 supporting the sheave 10-1 is suitable for being moved vertically in order to adjust the position of the top of the sheave relative to the plane tangential to the top face of the turntable 4-1 in front of which it is arranged.

As shown in FIG. 3, such swiveling about the second axis of rotation $Z_1Z'_1$ of said sheave 10-1 takes place progressively as the last point of contact of the last turn of the pipe wound on said turntable moves away from the center of the turntable between two limit points O and M, O being the point closest to the cylinder 4-3 (pipe fully unwound) and M being the point closest to the periphery of the turntable (pipe fully wound), as shown in FIG. 3.

Also in FIG. 3, the three sheaves 10-1: 10-1*a*, 10-1*b*, and 10-1*c* are offset from one another in the horizontal direction $Y_1Y'_1$ parallel to the side 1*d*. Furthermore, the substantially vertical axial planes P1, P2, and P3 of the three sheaves 10-1*a*, 10-1*b*, and 10-1*c* respectively may present variable angles of orientation α1, α2, and α3 respectively relative to said direction $Y_1Y'_1$. Said substantially vertical axial planes P1, P2, and P3 of the three sheaves can swivel about said second axes of rotation through respective angles β1, β2, and β3 between:

- a first limit position in which said pipe portion 3-2 leaving said turntable 4-1 for passing over the inlet of said sheave 10-1 is level with the last wound turn at the periphery of said turntable 4-1 at M; and
- a second limit position for said swiveling of each of the sheaves 10-1 in which the pipe portion 3-2 leaving the turntable is level with the point O corresponding to the position of said first flexible pipe end 3-1 close to the central cylinder 4-3.

Said axial planes P1, P2, and P3 of the three sheaves also correspond to the substantially vertical axial planes of the three upstream pipe portions extending between each of said turntables and each of said sheaves, respectively.

Each sheave 10-1 is preferably motor driven by a second motor 10-6, preferably a hydraulic motor, co-operating with a toothed ring (not shown) secured to said sheave and enabling each of said sheaves 10-1 to be driven to revolve about its own horizontal said first axis of revolution $Y_1Y'_1$.

The fact that the various sheaves 10-1 are arranged at different heights corresponding to the heights of said turntable 4-1 that it serves, and the fact that said sheaves 10-1 are arranged one beside another in a manner that is offset in the direction $Y_1Y'_1$, in spite of the swivel angles α1, α2, and α3 of each of the three sheaves 10-1*a*, 10-1*b*, 10-1*c*, there is no risk of said sheaves interfering with one another.

As shown in FIG. 2, curved intermediate portions 3-3 of flexible pipe 3 bent around a sheave 10-1 are followed by respective downstream pipe portions 3-4 in substantially vertical positions that reach the surface 20 of the sea on which the pipes float over respective fractions 3-5 of their length on going towards the ship 2.

As shown in FIG. 3, the vertical downstream portions 3-4 of the various pipes 3, 3*a*, 3*b*, 3*c* are offset in a direction $Y_1Y'_1$, but they remain in axial planes that are substantially vertical and substantially parallel in spite of said swiveling of said sheaves 10-1*a*, 10-1*b*, 10-1*c* about their second axes of rotation $Z_1Z'_1$.

Figure 1C:
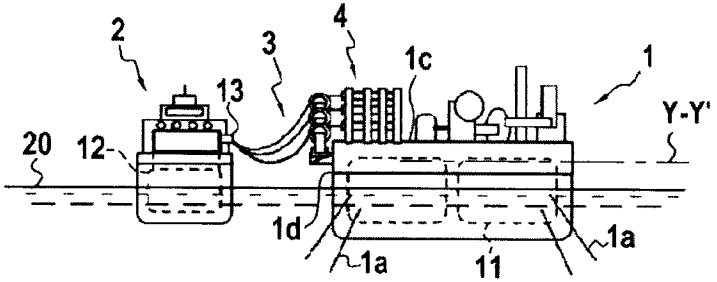
FIG. 1C is a side view of a floating support 1-1 of the FPSO type for producing and storing LNG, shown while offloading to an offloading ship 2 of the methane tanker type in a configuration referred to as an "alongside" configuration, the FPSO being fitted with a flexible pipe storage and guide device 4 of the invention.
Figure 1B:
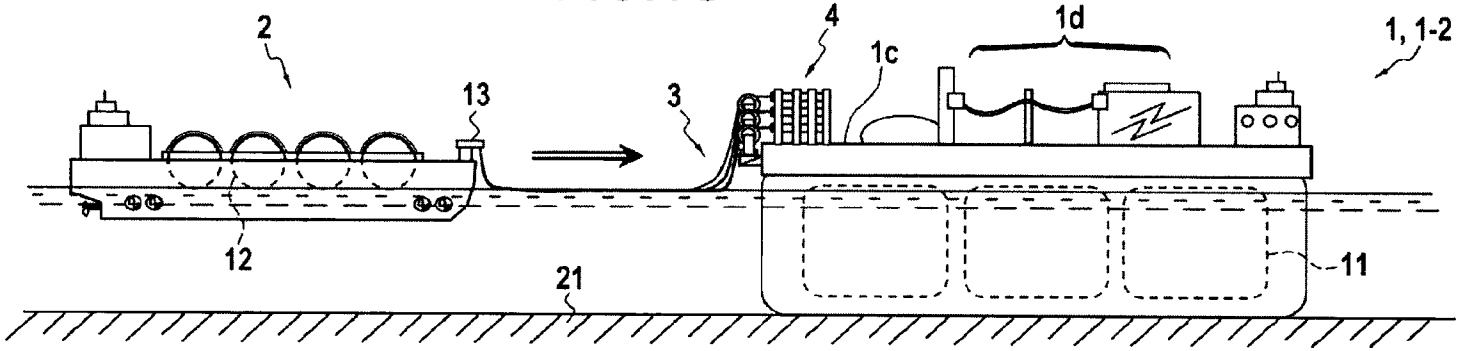
FIG. 1B is a side view of a support 1, 1-2 of the FSRU type grounded on the sea bottom 21 and including a regasification and electricity production unit 1*d* together with a transformer station for delivering electricity to land, shown while offloading from a methane tanker type ship referred to as a supply ship in a "tandem" configuration, said floating support being fitted with a flexible pipe storage and guide device 4 of the invention.

In FIG. 1C, there can be seen a variant implementation in which the methane tanker 2 is arranged alongside the floating support 1, with the floating support 1-1 and the ship 2 in this implementation being arranged parallel and side by side along their respective longitudinal sides extending in their longitudinal directions XX', and the flexible pipes 3 connecting the device 4 on board the support 1-2 to the ship 2 are located above the level of the sea 20. More particularly, the flexible pipes 3 adopt a catenary-shaped configuration above the level of the sea 20 from the outlets of the sheaves 10-1 level with the storage and guide devices 4 of the floating support 1 and extending to the common valve device 13 on board the offloading methane tanker ship 2.

By way of illustration, a turntable 4-1 presents a diameter of about 20 m. The height of the storage device 4, i.e. the height of the various posts 5*b* is about 15 m to 20 m for three turntables 4-1 that are spaced apart from one another vertically by 4 m to 5 m. A central cylinder 4-3 typically presents a diameter lying in the range 5 m to 8 m.

Such a device 4 is particularly suitable for receiving flexible pipes having a diameter lying in the range 120 mm to 600 mm and presenting a length lying in the range 120 m to 250 m.

Each of said turntables 4-1 can be set into rotation about its axis ZZ' independently of any of the others. The same applies to the motor drive for said rotary movement of said sheaves 10-1 about their first axis of rotation. It is thus possible to adjust the tension and the length of each of said flexible pipes 3*a*, 3*b*, and 3*c* independently of any of the others so that said flexible pipes extend between the vertical portions 3-4 at the outlet from the sheaves 10-1 and a common valve device 13, also known as a connection and purge device, that is located on board the offloading ship 2 and to which the various second ends of the various flexible pipes 3*a*, 3*b*, and 3*c* are connected, with the tensions and lengths of said pipes being adjusted to be substantially equal throughout all winding and unwinding operations of said flexible pipe. Generally speaking, since the respective diameters of each said flexible pipes may be different, it is necessary to have different numbers of revolutions of the turntables for each of said flexible pipes 3*a*, 3*b*, and 3*c* in order to store the same length for each flexible pipe.

Once the pipes are rewound onto their respective turntables 4-1, it is advantageous to use a turntable having a top face 4-1*a* that is of frustoconical shape that is concave 4-1*b* or convex 4-1*c*, as shown in FIGS. 4A and 4B respectively, in order to fully purge the residual LNG from within said wound pipe that has been used for transferring LNG from the floating support 1 to the methane tanker 2, and as a function of conditions of use for said pipes during purging as described below.

The flexible pipes 3*b*, 3*c* conveying LNG stored in a first tank 11 of the support 1 to the ship 2 are of very large diameter in order to optimize the rate at which LNG is transferred, whereas the returning gas can be conveyed using a single pipe, generally a pipe of smaller diameter, since head losses are much smaller for gas than for LNG.

It should be recalled that LNG is essentially constituted by liquid methane at −165° C., and that the offloading ships are constituted by methane tankers, i.e. by ships that transport LNG in tanks that, when empty, are in fact full of gaseous methane, possibly together with some nitrogen, coming from the regasification of LNG. The use of gas return pipes is intended firstly to remove the gas ceilings from the second tanks progressively as they are being filled with LNG coming from the first tanks, and secondly to remove LNG that has become regassified while it is being transported as a result of relative heating. Once the gas has been returned to the support 1, it is reliquefied to become LNG.

There follows a description of the connection and valve device 13 together with the method of purging flexible pipes before they are rewound on their turntables. This purging is necessary firstly to lighten the flexible pipes and make them easier to rewind, and also to avoid damaging said flexible pipes while they are being rewound on said turntables, where such damage could arise as a result of the pipes being excessively heavy when full of liquid, and because of the presence of sea water ice on the surface of the pipes or on the connection elements.

Figure 6:
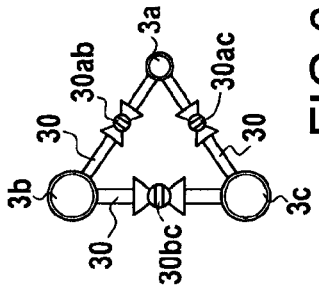
FIG. 6 is a face view in section on BB in FIG. 5A showing said first connection and valve device.
Figure 5A:
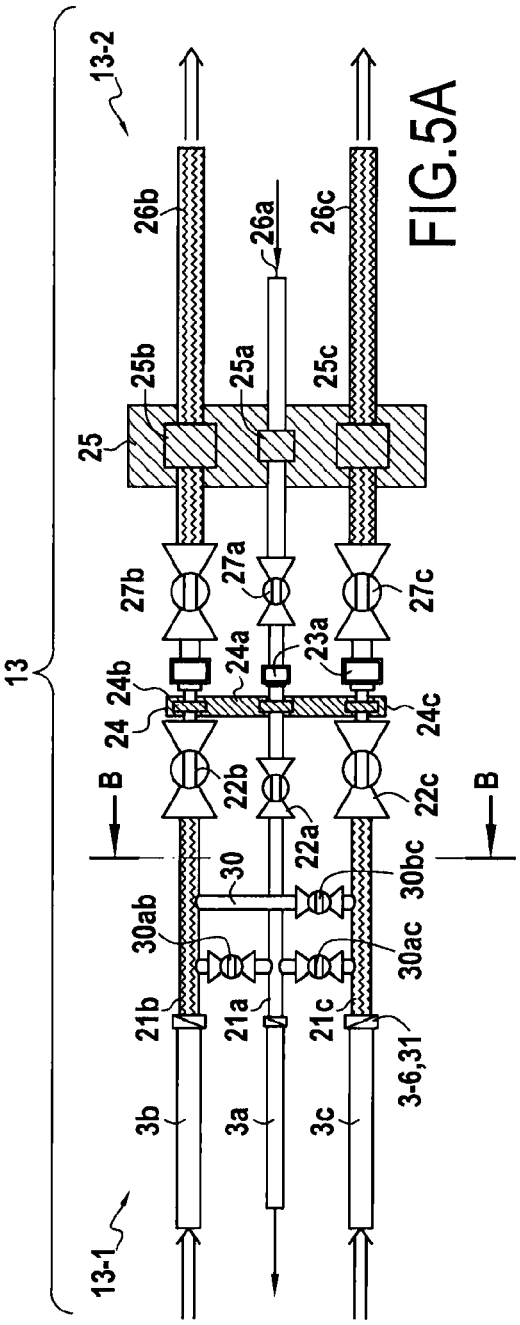
FIGS. 5A and 5B are plan views of a connection and valve device 13-1 for a set of three flexible pipes, comprising a first connection and valve device 13-1 at the ends of the three flexible pipes connected to a second connection device 13-2 arranged on board the offloading ship 2 (FIG. 5A); said first and second connection and valve devices 13-1 and 13-2 being disconnected in order to purge said pipe (FIG. 5B)
Figure 5B:
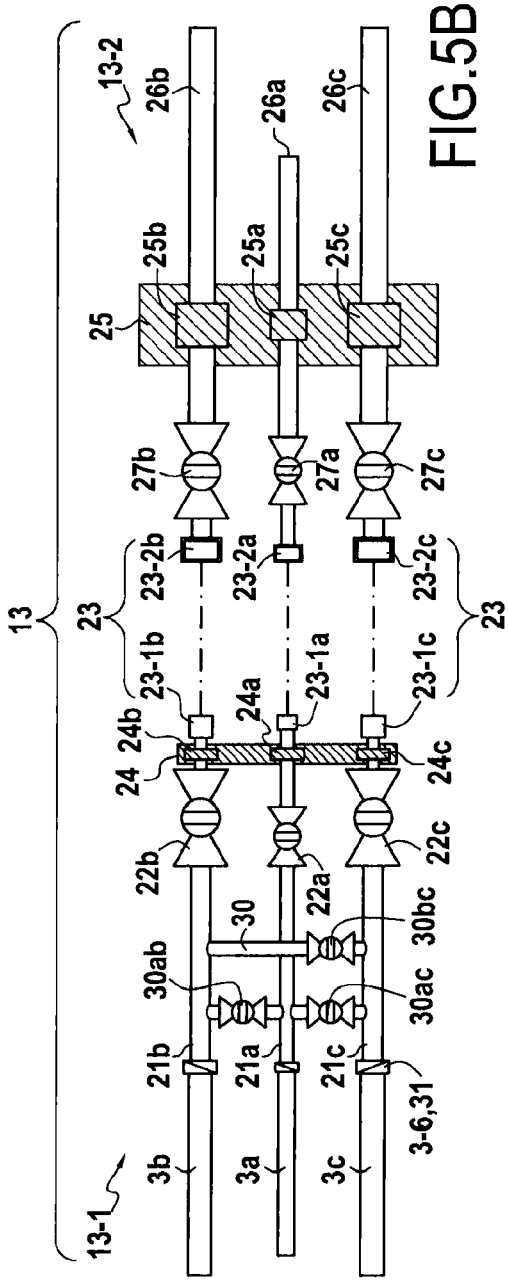

The connection and valve device 13 shown in FIGS. 5A, 5B, and 6 comprises:

a) a first valve and connection device 13-1 arranged at the ends of said flexible pipes 3*a*, 3*b*, and 3*c*, and comprising:

i. three first rigid pipe portions 21*a*, 21*b*, and 21*c* held in stationary positions relative to one another and in parallel; and ii. each said first rigid pipe portion 21*a*, 21*b*, and 21*c* comprising:

at a first end, a first pipe coupling element 23-1*a*, 23-1*b*, 23-1*c* constituted by a male or female portion of an automatic connector;

at its second end 3-6, an assembly flange 31 assembled to said second end 3-6 of the corresponding flexible pipe 3*a*, 3*b*, 3*c;* between the two ends of each said first rigid pipe portion, each of said first rigid pipe portions has two communication branch connections 30 each having a first communication valve 30*ab*, 30*ac*, 30*bc*, said branch connection 30 enabling each said first rigid pipe portion to communicate with one of the other two first rigid pipe portions of said device 13-1; and a first connection valve 22*a*, 22*b*, 22*c* situated between said first coupling element 23-1*a*, 23-1*b*, 23-1*c* and said branch connection 30 that is the closest to said first end of said first device 13-1; and b) a second connection and valve device 13-2 arranged on board said offloading ship 2 and comprising:

three second rigid pipe portions 26*a*, 26*b*, 26*c* held in stationary positions relative to one another and in parallel;

each said second rigid pipe portion 26*a*, 26*b*, 26*c* communicating at one of its ends with a said second tank 12 of the ship 2 and having at its other end a first complementary pipe coupling element 23-2*a*, 23-2*b*, 23-2*c*, said first complementary coupling elements being constituted by a female and/or respectively male portion of an automatic connector, i.e. a portion that is complementary to a said first coupling element 23 specifically so as to enable said first device 13-1 and said second device 13-2 to be coupled together; and each said second rigid pipe portion further including a second connection valve 27*a*, 27*b*, 27*c*. Said first rigid pipe portions being held together in a mutually parallel assembly by a first rigid support 24 to which they are secured at 24*a*, 24*b*, and 24*c*. Likewise, said second rigid pipe portions 26*a*, 26*b*, 26*c* are held together as a mutually parallel assembly by a second rigid support 25 to which they are secured at 25*a*, 25*b*, and 25*c*.

Advantageously, the various valves are ball valves or butterfly valves.

Because said first coupling elements are held together securely at constant distances from one another by said first support 24 to which they are secured at 24*a*, 24*b*, and 24*c*, and because said first complementary coupling elements are likewise held firstly at constant distances from one another that areentical to the distances between said first coupling elements, said first and second devices 13-1 and 13-2 can be connected together automatically by remotely controlled actuators (not shown), with it being possible for this to be done in a single sequence.

FIG. 5B is a plan view showing the connectors during an approach stage prior to connection, with all of the valves 22*a*, 22*b*, and 22*c* of the devices 13-1 and 13-2 being closed.

In FIG. 5A, the automatic connectors 23-1/23-2 are locked in leaktight manner and the valves 22*a*-22*b*-22*c* and also the valves 27*a*-27*b*-27*c* are in the open position, thus allowing LNG to pass from left to right in the two pipes 3*b* and 3*c* from the support 4 to the offloading ship 2, and allowing methane gas to pass in the return direction, from right to left, in the central pipe 3*a* from the offloading ship 2 to the FPSO 1.

For clarity of explanations with reference to FIGS. 5A-5B, 7A-7B-7C-7D, and 8A-8B, transfers of LNG are represented by a two-line arrow and transfers of gas are represented by a single-line arrow, with the length of such an arrow being proportional to the flow rate in the corresponding pipe.

The first valve device 13-1 is provided with a third series of communication valves between said first pipe portions 21*a*-21*b*-21*c* that are arranged as follows:

a valve 30*ac* connects together the first pipe portions 21*a* and 21*c;* a valve 30*ab* connects together the first pipe portions 21*a* and 21*b*; and a valve 30*bc* connects together the first pipe portions 21*b* and 21*c*.

During operations of transferring LNG from the offloading ship 2, said three vales 30*ab*, 30*ac*, and 30*bc* are in the closed position, as shown in FIG. 5A.

Figure 7A:
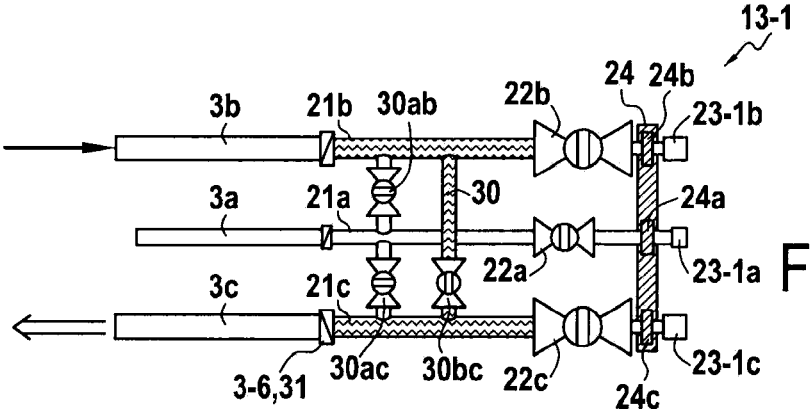
FIGS. 7A, 7B, 7C, and 7D are diagrammatic views showing various possible arrangements for fluid flow between the flexible pipes when the various valves of the first connection and valve device 13-1 are closed, in order to purge said flexible pipes.

In order not to leave the flexible pipes 3*a*, 3*b*, 3*c* floating on the sea between two transfers of LNG, which might represent a duration of several weeks, the flexible pipes are rewound on the turntables 4-1, preferably after they have been purged as follows:

the valves 22*a*-22*b*-22*c* of the first common valve device 13-1 and also the valves 27*a*, 27*b*, 27*c* of the second common valve device 13-2 on board the offloading ship 2 are all closed; then said coupling elements 23 of the first and second valve devices 13-1 and 13-2 are disconnected; then the flexible pipes 3*a*, 3*b*, 3*c* together with their first connection device 13-1 are let go, which flexible pipes then float on the surface of the water 20; then a communication valve 30*bc* between the two first rigid pipe portions 21*b* and 21*c* communicating with the flexible pipes 3*b* and 3*c* respectively as shown in FIG. 7A are opened; then a first pipe, e.g. the pipe 3*b*, is pressurized from the FPSO 1 to a pressure P with the help of gas, generally methane or a mixture of nitrogen and methane so as to be able to push the LNG;

the gas pressure pushes the LNG within said pipe 3*b* and the plane of separation between the liquid and gas phases moves progressively downwards in said pipe 3*b* as the LNG rises towards the FPSO via the second pipe 3*c*. Once said plane of separation reaches the pipe portion 3-5 at sea level, the flexible pipe 3*b* is then substantially horizontal and the gas continues to push, but a two-phase mixture then forms under pressure that travels towards the first valve device 13-1, and then passes through said valve 30*bc* and returns therefrom towards the FPSO via the flexible pipe 3*c*. The two-phase mixture has bubbles of small diameter at the level of the surface of the sea, but as soon as they reach the vertical portion 3-4 of said pipe 3*c*, given that hydrostatic pressure decreases on rising towards the deck of the FPSO, the bubbles become larger and the apparent density of the mixture decreases, thereby correspondingly accelerating the speed of the rising two-phase column, and as a result improving the entrainment of the liquid phase; and then when the horizontal portions 3-5 of the two flexible pipes 3*b* and 3*c* are substantially emptied, i.e. are substantially full of gas, the flow rate of gas from the FPSO in the pipe 3*b* is accelerated so as to greatly increase the disturbance to the two-phase flow in the substantially vertical portion 3-4 of the second pipe 3*c*, thereby having the effect of optimally entraining particles of LNG and thus enabling at least 85% and in practice 85% to 95% of the inside volume of both pipes 3*b* and 3*c*.

Figure 8A:
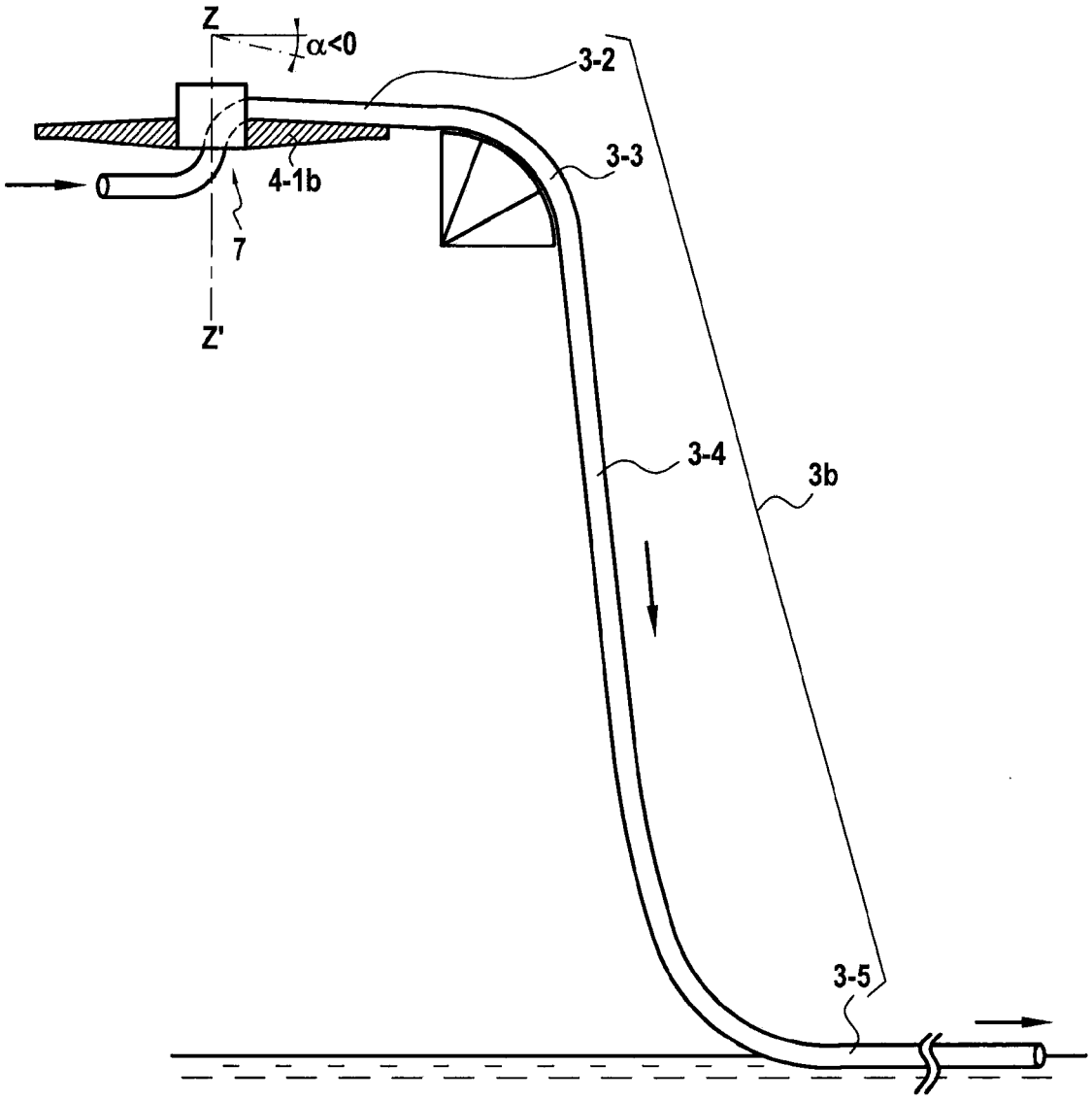
FIGS. 8A and 8B show a flexible pipe 3*b*, 3*c* for transferring LNG from a turntable of convex shape to an offloading ship 2 while purging said pipe (FIG. 8A) and a flexible pipe 3*a* for returning gas co-operating with a turntable of concave shape while it is being purged (FIG. 8B).
Figure 8B:
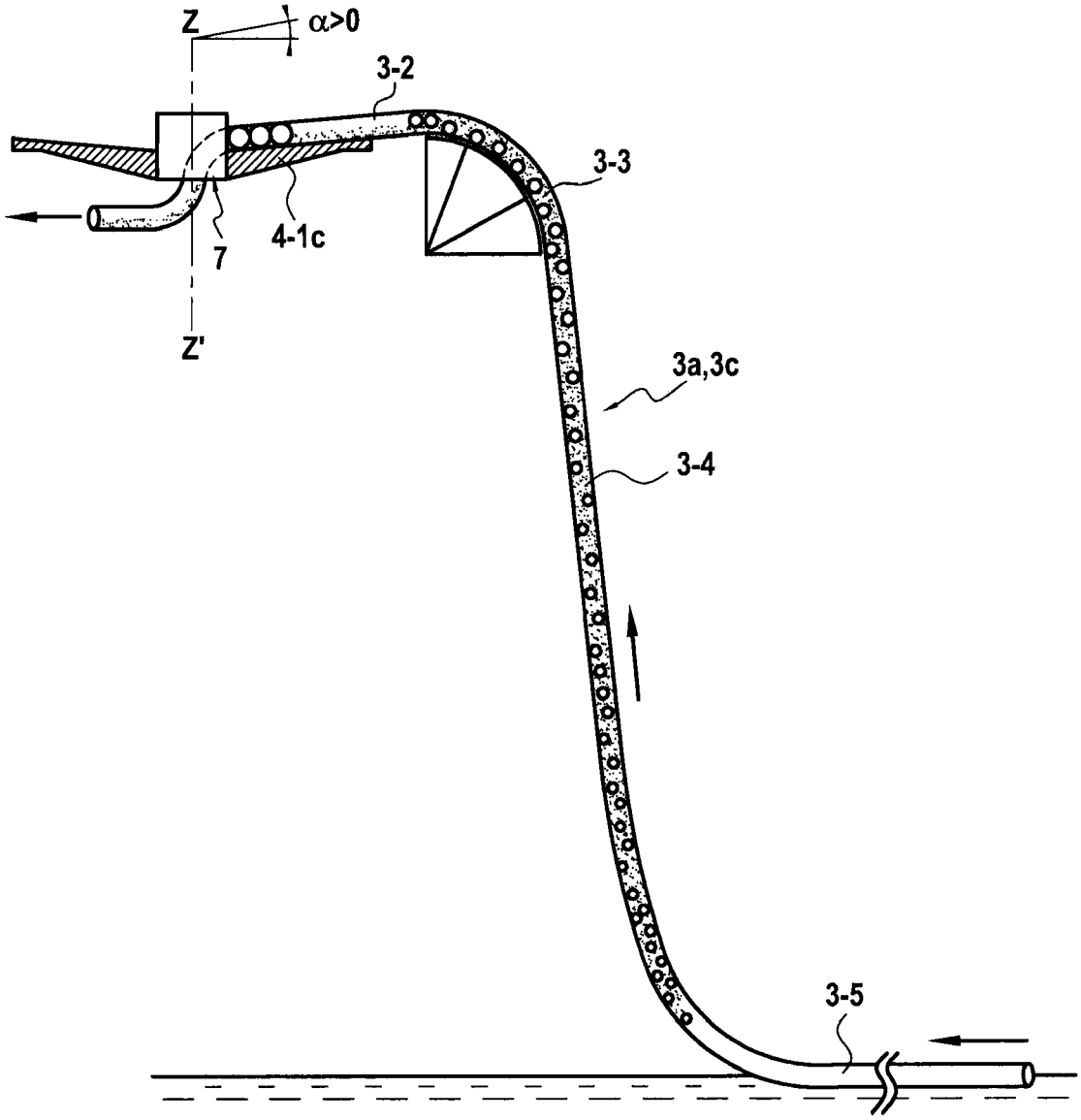

More particularly, and as a general rule, the pipe 3*b* is empty while liquid remains in the pipe 3*c* occupying 10% to 20% of the inside volume of the pipe 3*c*, in particular in its substantially vertical portion 3-4, as shown in FIG. 8B.

The purge process described above with reference to FIG. 7A is relatively fast and purging can thus be performed on pipes having a length of 100 m to 150 m in a duration of half an hour to 1 hour (h), whereas more than 24 h would be required for the LNG contained in the pipes to heat up and become gaseous.

Figure 7B:
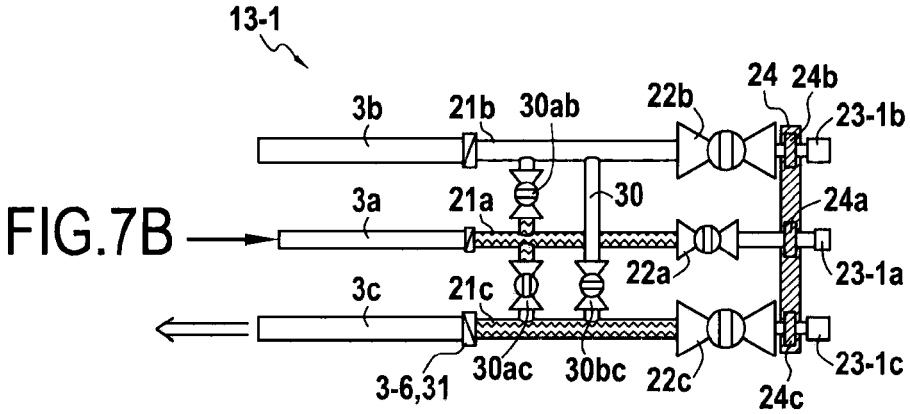
Figure 7C:
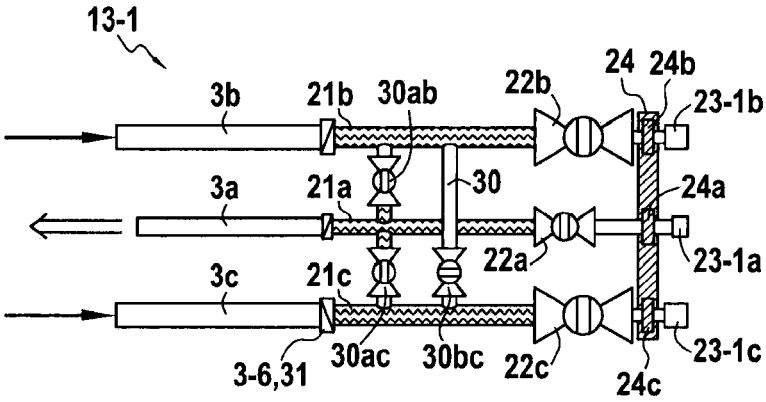

FIGS. 7B and 7C show a technique for purging the flexible pipes 3*b* and 3*c* more completely, in which a first flexible pipe 3*c* is purged by injecting gas from the gas return pipe 3*a*. For this purpose, the valve 30*ac* is opened while the valves 30*ab* and 30*bc* are closed, as shown in FIG. 7B. Purging is stopped when substantially all of the LNG, i.e. at least 85% of the LNG in the pipe 3*c* has been recovered on board the FPSO. Thereafter, the valve 30*ac* is closed and the valve 30*ab* is opened, thereby having the effect of purging the second flexible pipe 3*b* in the same manner, until at least 85% of the LNG in the pipe 3*b* has been recovered on board the FPSO. Finally, as shown in FIG. 7C, the direction of gas injection is reversed, with gas being injected directly into the two flexible pipes 3*b* and 3*c*, and with the LNG then returning via the pipe 3*a*. This arrangement presents a major advantage when said gas return pipe 3*a* is of smaller diameter. In order to cause the two-phase mixture to rise in the vertical portion 3-4 of the pipe 3*a*, the flow rate of gas needed in the pipes 3*b* and 3*c* is considerably smaller than in the situation described above with reference to FIG. 5A in which the two flexible pipes 3*b* and 3*c* are generally of the same diameter for the purpose of optimizing the rate at which LNG is transferred.

In order to optimize emptying of the rising vertical pipe portion, it is appropriate to create a purge gas speed greater than 1.5 m/s, preferably greater than 3 m/s, and more preferably greater than 5 m/s. Thus, giving consideration to a pipe of small diameter, the gas flow rate needed to obtain such a speed decreases with the square of the ratio of the diameters, thus illustrating the advantageous nature of having a gas return pipe that is of smaller diameter.

Figure 7D:
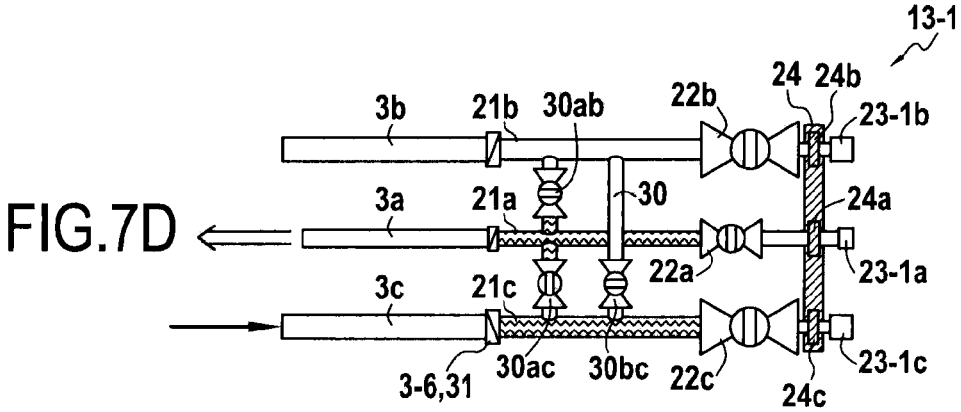

To further improve this stage of purging the pipes 3*b* and 3*c*, it is advantageous to proceed sequentially as shown in FIG. 7D in order to purge the pipe 3*c* completely by closing the valve 30*ab* in order to finalize 5 the purging of the flexible pipe 3*c*, and then by opening the same valve 30*ab* while closing the valve 30*ac* in order to finalize purging of the flexible pipe 3*c* by injecting gas into the pipe 3*c* so to evacuate the residual LNG via the pipe 3*a*.

FIG. 8A is a side view of the flexible pipe 3*b* from its storage turntable down to sea level. The convex storage turntable 4-1*b* presents a convex frustoconical top face with a negative angle α, which is advantageous for the stage of purging flexible pipes, since in the description of the invention as given with reference to FIG. 7A, it is via this pipe that the purge gas is injected, and because of the conical shape of the storage turntable, the pipe naturally empties downwards.

FIG. 8B is a side view of the flexible pipe 3*b* from its storage turntable down to sea level. The concave storage turntable 4-1*c* presents a concave frustoconical top face with a positive angle α, which is advantageous for the stage of purging the flexible pipes, since in the description of the invention as given with reference to FIGS. 7A and 7B, it is via this pipe that the two-phase mixture rises towards the FPSO, and it is via the conical shape of the storage turntable that the pipe stored as a spiral winding on said conical turntable empties naturally towards the rotary joint 7 situated on the axis ZZ' of the turntable. This FIG. 8B also shows that pipes practically empty in its horizontal portion 3-5, with the two-phase mixture in the substantially cylindrical portion 3-4 presenting bubbles of small diameter towards the bottom and of diameter that increases as the mixture rises along the pipe towards the storage turntable.

For the pipe portion 3-4 having a height lying in the range 30 m to 35 m, corresponding to a pressure difference of 1.5 bars to 2 bars, the bubbles in the bottom portion will have a diameter lying in the range 5 mm to 10 mm, while the bubbles in the top portion will have a much larger diameter as a result of the pressure difference, lying in the range several centimeters to several decimeters, thereby having the effect of reducing the density of the two-phase mixture in the fluid column and thus encouraging its entrainment and offload at the level of the turntable: with this phenomenon being referred to as "gas-lift".

In the purging technique described with reference to FIGS. 7C and 7D, the turntable for storing the gas return pipe (FIG. 7C) 3*a* (FIG. 7D) is advantageously of the concave conical type with a positive angle α.

When the gas return pipe presents an inside diameter that is smaller than the inside diameter of the LNG pipes, the preferred purging method comprises the following two purging steps:

a first step of purging a pipe 3*b* by injecting gas into the pipe 3*b* leading to the pipe 3*b* being purged completely while purging the pipe 3*c* only partially given the residual LNG gas, in particular in the portion 3-4 of the pipe 3*c* when the various valves are operated as described with reference to FIG. 7A. At the end of this first step, the pipe 3*c* still retains about 15% of its inside volume filled with LNG;

then the valve 30*bc* is closed and the valve 30*ac* is open; and the second purging step is performed by injecting gas into the pipe 3*c* and discharging it via the gas return pipe 3*a* of smaller diameter by setting the various valves in the manner described with reference to FIG. 7C. Because the gas is exhausted via the smaller-diameter pipe 3*a*, the flow rate of gas needed in the pipe 3*c* is considerably reduced so as to obtain an optimum speed for the two-phase fluid, corresponding to a gas speed greater than 1.5 m/s, preferably greater than 3 m/s, and more preferably greater than 5 m/s. Because the section of the pipe 3*a* is smaller, the transfer of liquid takes place more slowly, but purging is greatly improved thereby in terms of the ultimate percentage of two-phase liquid that is purged and in terms of overall duration.

Figure 1D:
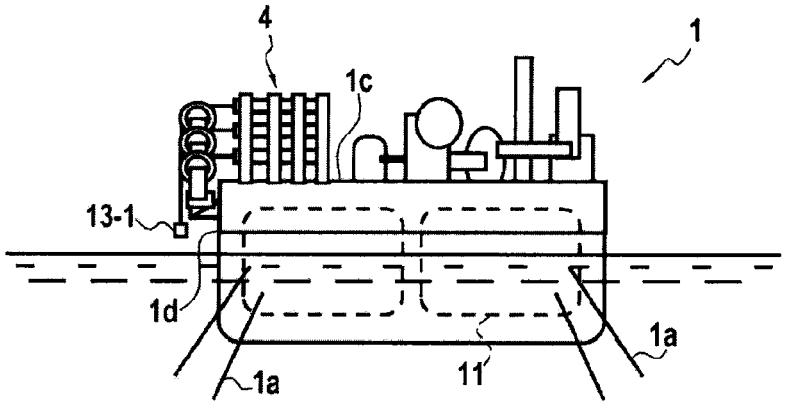
FIG. 1D is a side view of a floating support in which said flexible pipes are rewound onto a storage and guide device 4 by means of a said first connection device 13-1 that is above water.

After the three pipes 3*a*, 3*b*, and 3*c* have been purged, they are rewound onto their respective turntables until said first connection device 13-1 comes above the level of the water, and more particularly substantially just below the lowest turntable of the flexible pipes held together by the device 13-1, as shown in FIG. 1D, it thus being possible for the first connection device 13-1 to remain permanently connected to said second end 3-6 of said pipes 3*a*, 3*b*, and 3*c* that are connected together by said first device 13-1.

By way of example, a transfer device of the invention comprises:

two LNG flexible pipes having an inside diameter of 500 mm and an outside diameter of 900 mm, each of these pipes being 216 m long and being made up of 18 identical 12 m long segments assembled together by flanges, and weighing 300 kilograms per meter (kg/m) when empty;

a flexible gas return pipe with an inside diameter of 250 mm and an outside diameter of 400 mm, the pipes being 216 m long and being made up of 18 identical 12 m long segments assembled together by flanges and weighing 125 kg/m when empty;

a connection and valve device 13 fitted with ball valves 22 with an inside diameter of 500 mm for LNG and of 250 mm for gas return, the valves 30*ab*-30*ac*-30*bc* being butterfly valves with a flow-passing diameter of 250 mm, and weighing about 20 (metric) tonnes (t); and three motor-driven storage turntables 4 having an outside diameter of 23 m and a cylinder of diameter of 5 m, three motor-driven sheaves with a grooved diameter of 5 m, and their supporting structure, the entire assembly weighing about 1000 t.

The procedure of purging the pipes is performed at a gas speed of 4 m/s under such conditions and occupies a total duration of 30 minutes (min) to 45 min so as to obtain an overall residue of LNG that is less than 1% of the overall volume of a pipe, which represents about 425 liters (L) of residual LNG that then produce 250 cubic meters ($m^3$) of gaseous methane that will thus ultimately be reliquefied on board the FPSO.

The invention claimed is:

1. A support installed at sea, in grounded or floating manner, said support being fitted on its surface with a storage and guide device for storing and guiding flexible pipes and suitable for storing and guiding a plurality of said flexible pipes, wherein the storage and guide device comprises:

a first carrier structure resting on or secured to the deck of said support close to a side of said support, said first carrier structure supporting a plurality of circular turntables arranged one above another;

each of said turntables being suitable for being driven in rotation in powered manner by a first motor about a vertical central axis ZZ' independently of one another, each turntable having a central orifice surmounted by a central cylinder against and around which a said flexible pipe can be wound in concentric juxtaposed spiral turns of increasing diameter resting on the top face of said turntable, said central orifice of said turntable being fitted with a rotary joint coupling suitable for providing coupling between firstly a first end that is closest to said central cylinder of a flexible pipe wound around said flexible cylinder, said first pipe end being suitable for being driven in rotation together with said turntable, and secondly an end of a stationary transfer pipe having its other end in communication with at least one first tank within said support; and a plurality of guide means, each said guide means being suitable for guiding the portion of said pipe leaving a respective one of each of said turntables in continuity with the portion of pipe wound on said turntable, in such a manner that the various said pipe portions leaving the various turntables are arranged in straight lines, being offset in different positions along a horizontal direction $Y_1Y'_1$ parallel to said side, at different heights, and capable of adopting different angular orientations for their vertical axial planes relative to said horizontal direction $Y_1Y_1'$ parallel to said side.

2. The support according to claim 1, wherein at least one said flexible pipe is wound against and around a said central cylinder in concentric juxtaposed spiral turns of increasing diameters resting on said turntable, said central cylinder presenting a radius greater than the minimum radius of curvature of said flexible pipe.

3. The support according to claim 1, wherein each guide means is arranged at a different height facing a respective one of each of said turntables so as to be suitable for supporting an intermediate curved pipe portion between a downstream portion of said pipe in a substantially vertical position beside said side and a said upstream pipe portion leaving the turntable in continuity with the wound pipe portion resting on a said turntable, said upstream pipe portion leaving the turntable extending on a virtual plane P that is substantially tangential to the surface of the top face of said turntable on which said wound pipe portion is wound, the various downstream pipe portions in substantially vertical positions beside said side being arranged in positions that are offset relative to one another in a said-direction $Y_2Y_2'$ parallel to said side on leaving said sheaves.

4. The support according to claim 3, wherein each said guide means comprises a sheave mounted to revolve about a horizontal first axis of rotation $Y_1Y_1'$, said sheave also being suitable for swiveling about a vertical second axis of rotation $Z_1Z_1'$ extending along a diameter of the sheave, said first axis of rotation about which each said sheave revolves being controlled by a second motor.

5. The support according to claim 4, wherein the various sheaves are arranged offset side by side relative to one another in said horizontal direction $Y_1Y'_1$ parallel to said side at different heights, the top of each sheave being positioned substantially level with a plane P tangential to the top face of a said turntable.

6. The support according to claim 5, wherein each sheave is supported by a second carrier structure arranged outside said support and fastened to a common side at a different position in a said horizontal direction $Y_1Y_1'$ parallel to said side, each sheave being mounted to swivel about said vertical second axis of rotation $Z_1Z_1'$ relative to a portion of its said second carrier structure fastened to said side.

7. The support according to claim 1, wherein each said turntable includes or co-operates on its under face with wheels suitable for co-operating with or respectively supported by elements of said carrier structure, and each said turntable including a bearing at said central orifice, the bearing being secured to said carrier structure and being suitable for enabling said turntable to rotate relative to said first carrier structure.

8. The support according to claim 1, wherein at least one said turntable presents a top face that is plane and horizontal.

9. The support according to claim 1, wherein at least one said turntable presents a top face of convex frustoconical shape.

10. The support according to claim 1, wherein at least one said turntable presents a top face of concave frustoconical shape.

11. The support according to claim 1, that is fitted with a plurality, n, of flexible pipes each co-operating at its said first end with a respective said turntable, said flexible pipes being connected together at their second ends by a first connection and valve device having n rigid first pipe portions held in parallel fixed positions relative to one another, n being an integer not less than 3, each said first pipe portion comprising:

at a first end, a first pipe coupling element, which is a male or a female portion of an automatic connector;

at its second end, a second coupling element, which is a flange, assembled to the second end of a said flexible pipe;

each said first pipe portion including, between its two ends n−1 branch connections enabling it to communicate with respective ones of the n−1 other said first rigid pipe portions, each said branch connection including a first communication valve;

a first connection valve situated between said first coupling element and said branch connection;

said first pipe portions being held parallel by a first rigid support to which they are secured; and said first communication valves being butterfly valves and said first connection valves being ball valves.

12. The support according to claim 11, wherein said flexible pipes extend or are suitable for extending between said support and a ship of the methane tanker type, arranged alongside said support or in tandem facing said side, and said first connection and valve device is connected to a second connection and valve device arranged or suitable for being arranged on board said methane tanker type ship, said second connection and valve device comprising:

n rigid second pipe portions;

each said second pipe portion communicating at one of its ends with a said-second tank and including at its other end a first complementary pipe coupling element, said first complementary pipe coupling element being suitable for co-operating in reversible coupling with said first coupling element, said first complementary pipe coupling element being a female or male automatic connector portion, respectively;

said second pipe portions being held in parallel fixed positions relative to one another so as to enable said first complementary pipe coupling element to be coupled with said first coupling element;

each said second pipe portion having a second connection valve suitable for allowing or preventing fluid from flowing in said second pipe portion towards or from said first complementary pipe coupling element when open or closed, respectively;

said second pipe portions being held parallel to one another by a second rigid support to which they are secured; and said second connection valves being ball valves.

13. A method of transferring a liquid or gaseous petroleum fluid, wherein said petroleum fluid is transferred via at least two flexible pipes, extending between said support according to claim 1 and a ship of the methane tanker type, arranged alongside or in tandem adjacent to said floating support facing said side, said flexible pipes being guided with the help of said storage and guide device.

14. The method according to claim 13, wherein said flexible pipes are floating pipes, floating on the surface over a fraction of the distance between said support and said ship of the methane tanker type.

15. The method according to claim 13, wherein use is made of at least one flexible pipe and at least two flexible pipes, herein after called "first" and "second" flexible pipes, within which liquefied gas is transferred between said floating support and at least one second tank of said ship of the methane tanker type, and of a third flexible pipe, of diameter smaller than the diameter of said first and second flexible pipes, within which gas corresponding to the gas ceiling of the second tank is transferred between a-said second tank to a first tank within said floating support or to a liquefaction unit on said support prior to being transferred to said first tank.

16. The method according to claim 13, wherein said flexible pipes are connected together at their second ends by a first connection and valve device having n rigid first pipe portions held in parallel fixed positions relative to one another, n being an integer not less than 3, each said first pipe portion comprising:

at a first end, a first pie coupling element, which is a male or a female portion of an automatic connector;

at its second end, a second coupling element, which is a flange, assembled to the second end of a said flexible pipe;

each said first pipe portion including between its two ends n−1 branch connections enabling it to communicate with respective ones of the n−1 other said first rigid pipe portions, each said branch connection including a first communication valve;

a first connection valve situated between said first coupling element and said branch connection;

said first pipe portions being held parallel by a first rigid support to which they are secured; and said first communication valves being butterfly valves and said first connection valves being ball valves; and wherein and said first connection and valve device is connected to a second connection and valve device arranged or suitable for being arranged on board said methane tanker type ship, said second connection and valve device comprising:

n rigid second pipe portions;

each said second pipe portion communicating at one of its ends with a second tank and including at its other end a first complementary pipe coupling element, said first complementary pipe coupling element being suitable for co-operating in reversible coupling with said first coupling element, said first complementary pipe coupling element being a female or male automatic connector portion, respectively;

said second pipe portions being held in parallel fixed positions relative to one another so as to enable said first complementary pipe coupling element to be coupled with said first coupling element;

each said second pipe portion having a second connection valve suitable for allowing or preventing fluid from flowing in said second pipe portion towards or from said first complementary pipe coupling element when open or closed, respectively;

said second pipe portions being held parallel to one another by a second rigid support to which they are secured;

said second connection valves being ball valves, and said floating flexible pipes that have been used for transferring liquid natural gas LNG from said support to a said ship, are purged by performing the following successive steps:

a. closing said first and second connection valves, and disconnecting said first and second connection and valve devices from each other, b. injecting gas into the first end of a first flexible pipe from said support and opening at least one said first communication valve between said first flexible pipe and a second flexible pipe assembled to the same said first connection and valve device, the other said first communication valves being closed; and then c. closing said first communication valve between said first and second flexible pipes when said first pipe has been emptied sufficiently.

17. The method according to claim 16, wherein after step c), said second pipe is purged completely by performing the following successive steps:

d. injecting gas from the support into said first end of said second pipe and opening said first communication valve between said second pipe and a third flexible pipe of smaller diameter than said second pipe so that the flow rate of purge gas is such that the speed of said gas is greater than 1.5 m/s, said other first communication valves being closed; and e. closing said first communication valve between said second and third pipes when said second pipe has been emptied sufficiently.

18. The method according to claim 16, wherein when all of said flexible pipes have been purged sufficiently, said flexible pipes are rewound onto their said turntables until the second ends of all of said flexible pipes are above water, with said first connection and valve device coming just under the lowest of the turntables co-operating with one of said flexible pipes.

19. The method according to claim 18, wherein said first pipe is wound on a said turntable presenting a top face of convex frustoconical shape.

20. The method according to claim 18, wherein at least one of said second and third flexible pipes used for transporting liquid, wound on a turntable of with a top face of frustoconical concave shape.

* * * * *